United States Patent [19]

Danheisser

[11] 4,049,114

[45] Sept. 20, 1977

[54] CONVERTIBLE CARTON

[75] Inventor: Hans Danheisser, Merrick, N.Y.

[73] Assignee: Immco Industries, Inc., Flushing, N.Y.

[21] Appl. No.: 708,686

[22] Filed: July 26, 1976

[51] Int. Cl.[2] ..... B65D 5/52; B65D 25/24

[52] U.S. Cl. ..... 206/44 B; 206/45.11; 206/45.16; 206/45.25; 248/174

[58] Field of Search ..... 206/44 R, 45.11, 45.13, 206/45.16, 45.18, 45.24, 44 B; 229/16 D; 248/174

[56] References Cited

U.S. PATENT DOCUMENTS

| | | | |
|---|---|---|---|
| 1,282,573 | 10/1918 | Hayden et al. | 206/45.2 X |
| 1,549,645 | 8/1925 | Windfuhr | 206/45.2 X |
| 1,850,020 | 3/1932 | Locke, Jr. | 206/45.25 |
| 2,186,071 | 1/1940 | Hornecker | 206/45.3 |
| 2,298,897 | 10/1942 | Myers | 206/45.24 |
| 3,168,192 | 2/1965 | Nicholson et al. | 206/45.2 X |
| 3,918,576 | 11/1975 | Taub | 206/44 R |

*Primary Examiner*—Steven E. Lipman

[57] ABSTRACT

A carton capable of storing and shipping goods in a tightly-packed orderly array, the carton being convertible into an open bin of larger volume in which the goods are in disarray to provide a jumble display conducive to sales. The carton is formed with a rectangular open shell and a drop-out base which in the storage mode is flat, whereby the carton then has a uniform depth, the base in the jumble mode assuming a trough-like configuration whereby the resultant bin then rests on one wall of the V-shaped trough and the shell is inclined to provide ready access to the bin.

11 Claims, 17 Drawing Figures

Fig. 2.
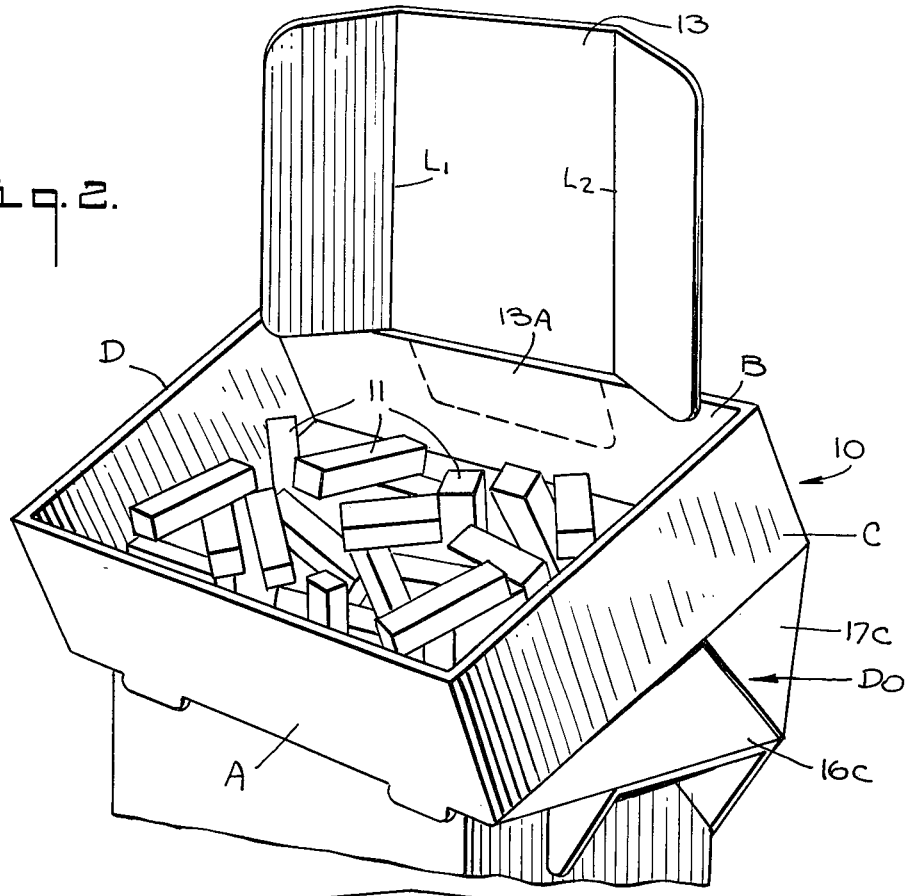
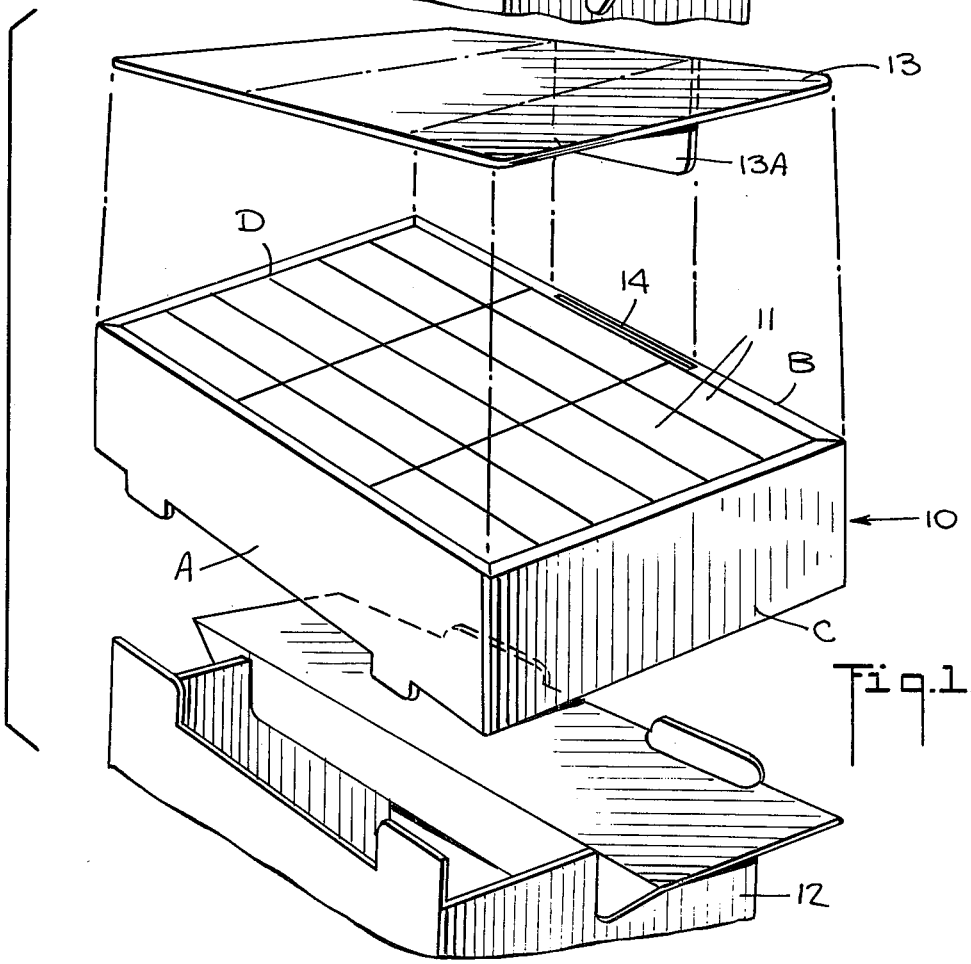
Fig. 1.

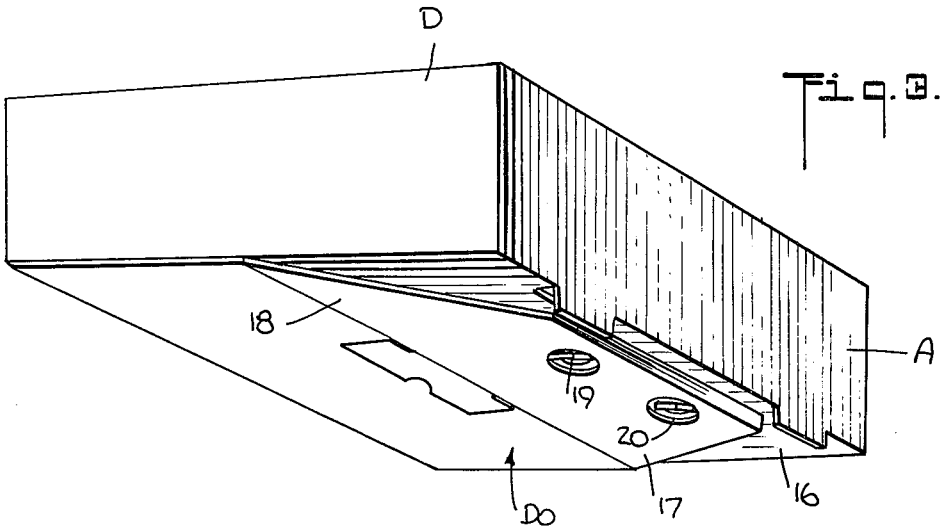
Fig. 3.
Fig. 7.
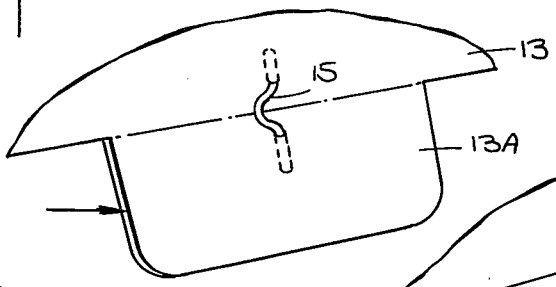
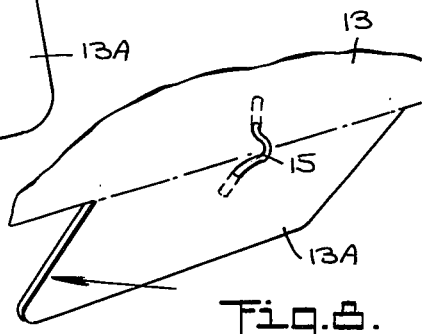
Fig. 8.
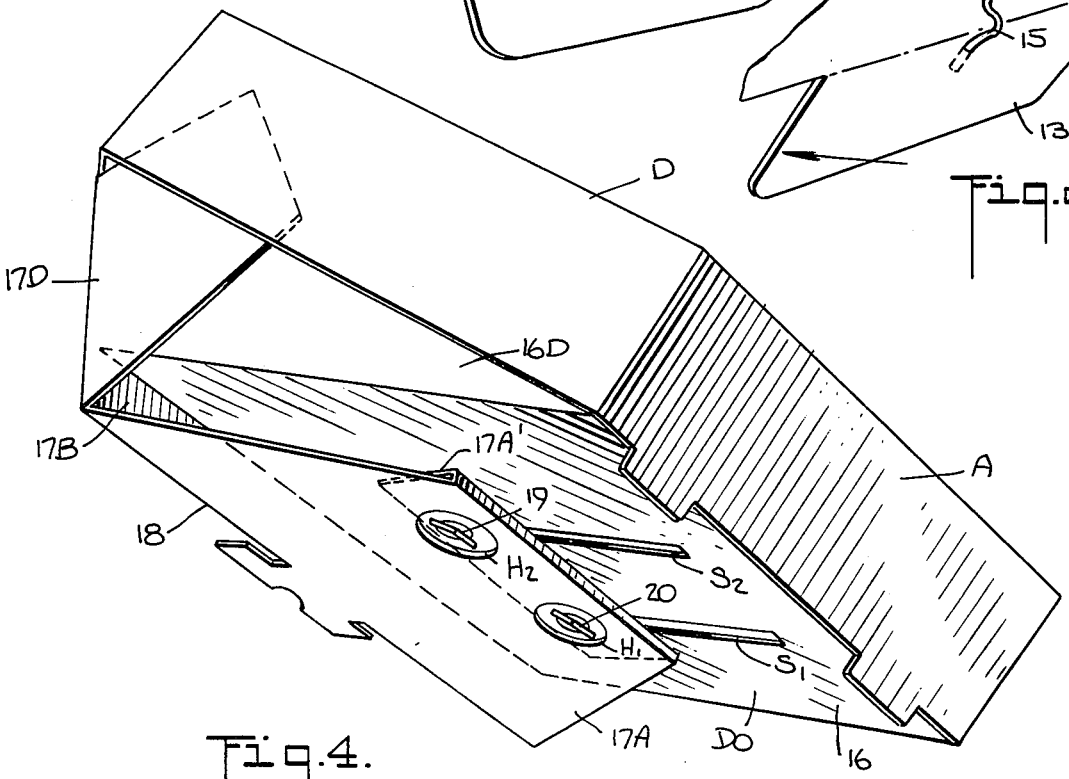
Fig. 4.

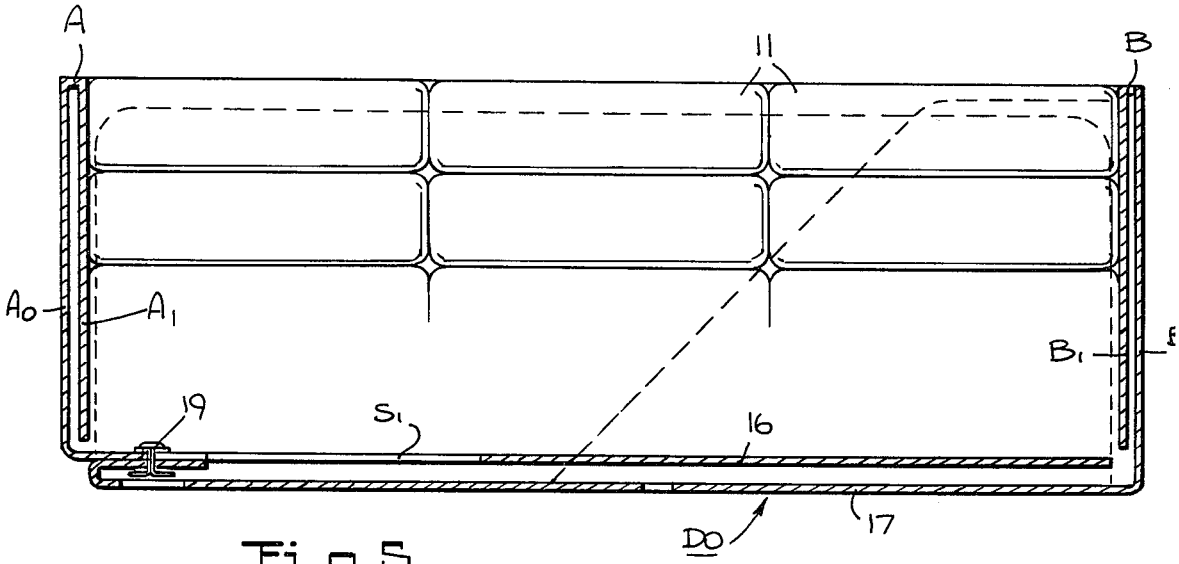
Fig. 5.
Fig. 6.
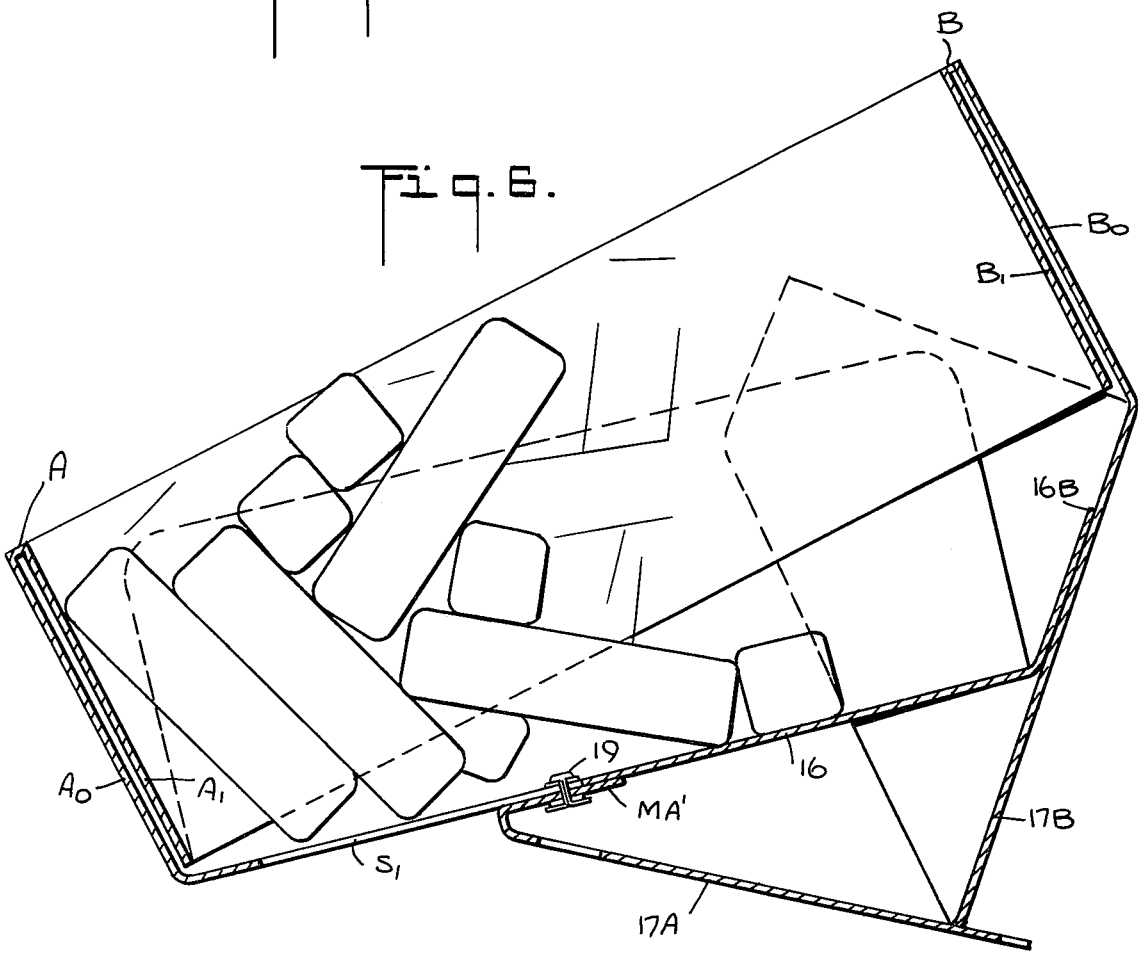

Fig. 10.
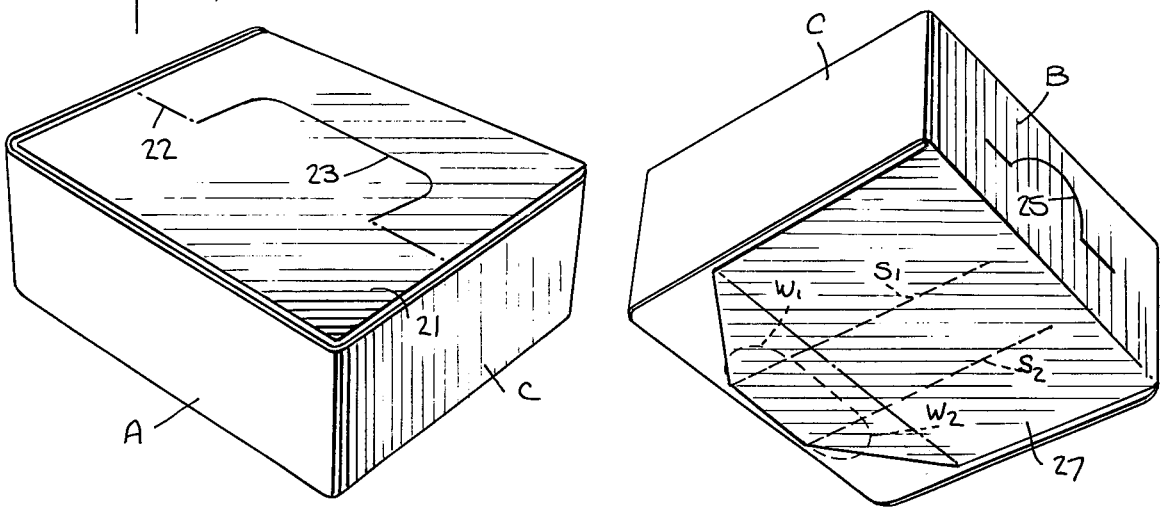
Fig. 11.
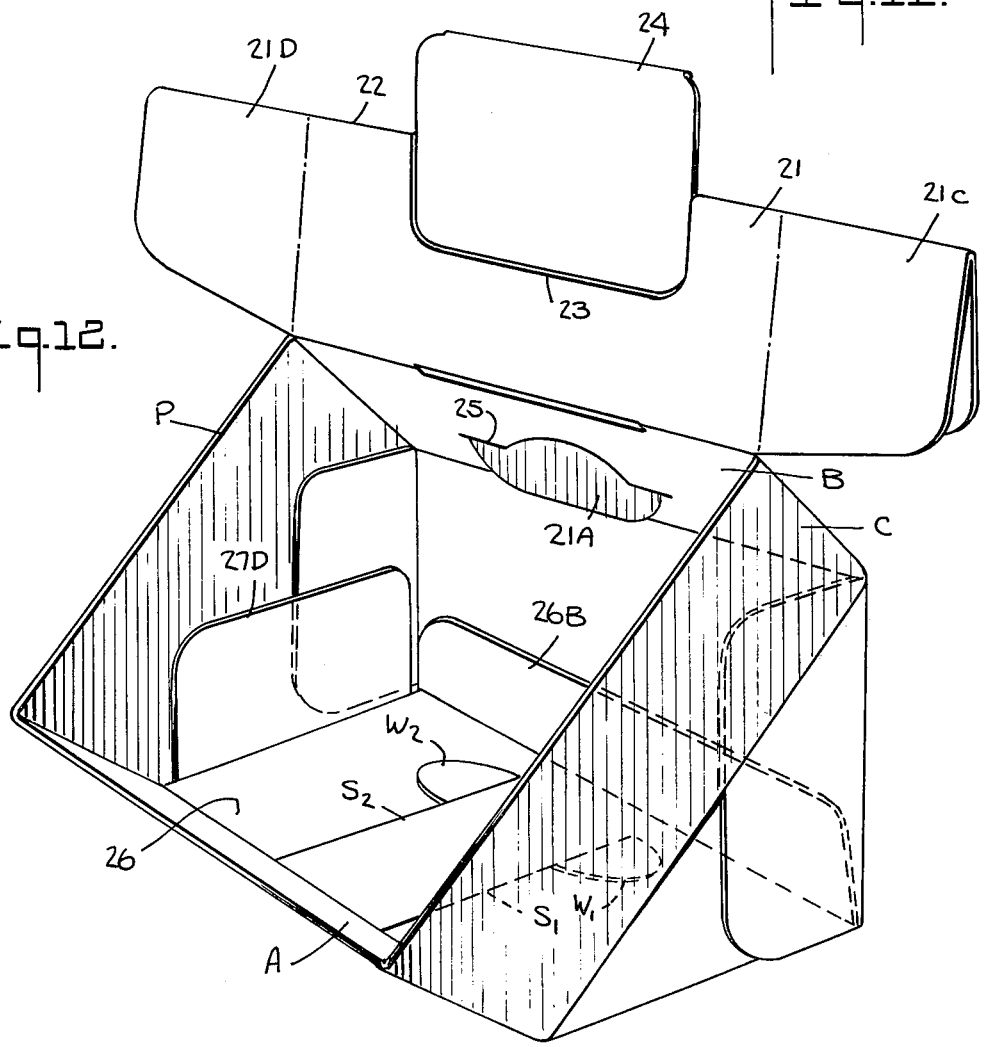
Fig. 12.

CONVERTIBLE CARTON

BACKGROUND OF INVENTION

This invention relates generally to cartons for storing, shipping and displaying merchandise, and more particularly to a carton which is convertible into an open bin of larger volume to provide a jumble display of its contents.

In the last quarter of a century, the distribution and sale of consumer goods have undergone revolutionary changes, and in place of the corner grocer, the family-owned drug store, the local dry goods store and other retail establishments at scattered locations, we now find supermarkets, large discount chains and department stores clustered together at huge shopping centers. Yet while major advances have been made in the technology of merchandising, the fact remains that in some respects consumer psychology resists innovation, so that an apparent improvement in merchanising techniques may cause a drop in sales.

For example, packaged goods are now shipped to a retail center in cartons, and at the center, the goods which are neatly stored in the cartons are transferred to open shelves where the goods are again aligned to provide an orderly display. Thus as the consumer with his shipping cart moves along the aisles of a supermarket, he sees cans and boxes of goods all uniformly stacked in imposing arrays. Obviously, the more carefully the goods are stacked, the greater the capacity of the shelves to carry large supplies of different items.

But while an orderly display of goods may impress the consumer with the cleanliness and efficiency of the market, it also affects his attitude toward making a purchase. Because of psychological factors which may be irrational but are nevertheless real, a consumer is reluctant to upset an orderly array of goods, for it implants in his mind a no-touch, keep-off-the-goods admonition.

Some store owners are aware of the inhibiting effect of an orderly display, and it is for this reason that such owners deliberately turn the clock back and jumble their goods in open bins in the manner of an old-fashioned bargain house. Experience has shown that a jumble display is more inviting to the consumer, for it may create the impression that the store owner is disposing of goods at much below their usual price. In any case, goods displayed in this fashion are more approachable, for the purchaser does not, in his unconscious, feel that he is upsetting the applecart and thereby violating some parental stricture.

In order to produce a jumble display, it was heretofore necessary for the store owner to specially construct or purchase open bins and to transfer the goods to be sold from the shipping cartons, the cartons then being discarded. It was not possible to open the carton and then jumble the goods therein, using the carton as the display bin. Conventional cartons have stable dimensions which are just adequate for containing the merchandise when tightly packed in an orderly manner. If these goods are then jumbled in a helter skelter manner, then they occupy a much greater volume and overflow the carton.

SUMMARY OF INVENTION

In view of the foregoing, it is the main object of this invention to provide a carton that is suitable for storing and shipping goods, the carbon being convertible into an open bin of larger volume in which the contents of the carton are in disarray to create a jumble display conducive to sales.

A significant advantage of a convertible carton in accordance with the invention is that it does away with the requirement for special jumble-display bins and obviates the need to transfer goods from a shipping carton to such bins, for the same carton serves both to ship and store the goods in an orderly array and to display the goods in a jumble fashion.

More particularly, it is an object of the invention to provide a convertible carton which is fabricated from a single blank of carton material, such as corrugated board, to create a carton having a drop-out base which in the storage mode of the carton is flat and in the jumble mode assumes a trough-like configuration.

Yet another object of the invention is to provide a convertible carton of high strength that may be mass-produced at low cost.

Briefly stated, these objects are attained in a convertible carton which includes an open rectangular shell and a drop-out base defined by overlapping upper and lower panels, the upper panel being hinged from the front wall of the shell, and the lower panel from the rear wall thereof.

The lower panel is divided by a fold line into a front section and a back section, the front edge of the front section being secured by a coupling element to a slot in the upper panel whereby the coupling element is slidable in the slot from an inactive position in which the lower panel is flat, in which case the carton operates in its storage mode and has a uniform depth, to an active position in which the front section of the lower panel is at an angle relative to the back section thereof to provide a trough having a V-shape, in which case the carton operates as a bin in the jumble mode.

To convert the carton from the storage to the jumble mode, the carton, with its contents uniformly packed therein, is raised to free the base, and a downward pressure is applied to the contents, causing the base to drop out and assume the jumble mode, whereby the contents of the carton falling into the trough are disarrayed by this action.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a convertible carton in accordance with a first preferred embodiment of the invention, the carton being shown in its storage mode with the cover thereof raised to expose the contents;

FIG. 2 shows the same carton in its jumble mode, the carton being supported for display on a pedestal;

FIG. 3 illustrates the carton in its storage mode as seen looking toward its drop-out base;

FIG. 4 shows in perspective the carton in the course of its conversion from the storage mode to the jumble mode;

FIG. 5 is a sectional view of the carton in its storage mode, the boxed contents therein being in a uniform array;

FIG. 6 is a sectional view of the carton in the course of its conversion from the storage to the jumble mode, the boxed contents falling into disarray as the base of the carton drops out;

FIG. 7 is a view of the flap of the carton cover, the flap being extended to permit the cover to serve as a sign board in conjunction with the carton in the jumble mode;

FIG. 8 is a view of the cover flap when the flap is folded down when the carton is in the storage mode;

FIG. 10 is a perspective view of a second preferred embodiment of a convertible carton in accordance with the invention as seen in the storage mode with its cover closed;

FIG. 11 is an underside view of the carton showing the drop-out base;

FIG. 12 illustrates the carton in its jumble mode;

DESCRIPTION OF INVENTION

First Embodiment

Figure 9:
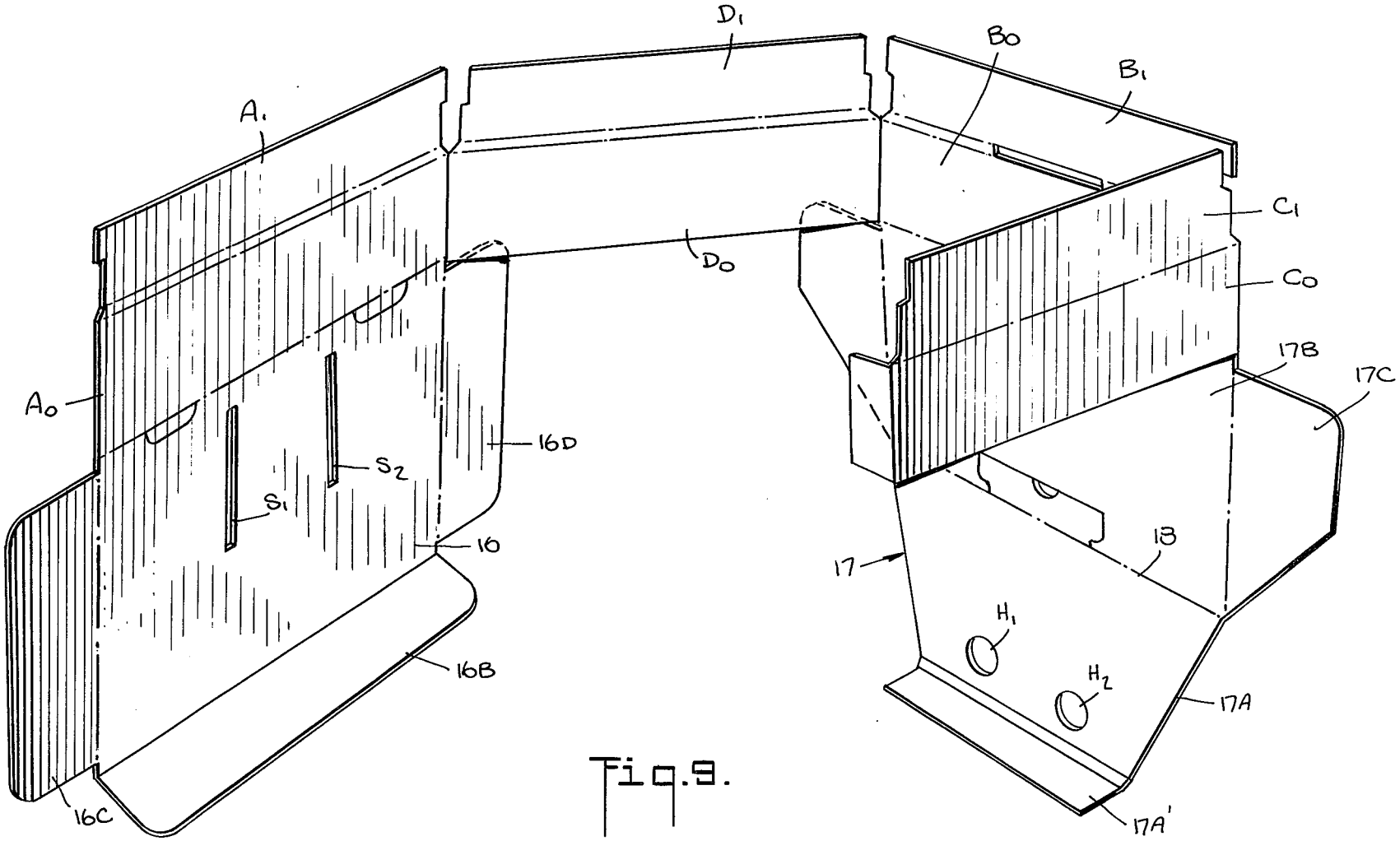
FIG. 9 is an expanded view of the single blank from which the convertible carton is fabricated.
Figures 13, 14, 15:
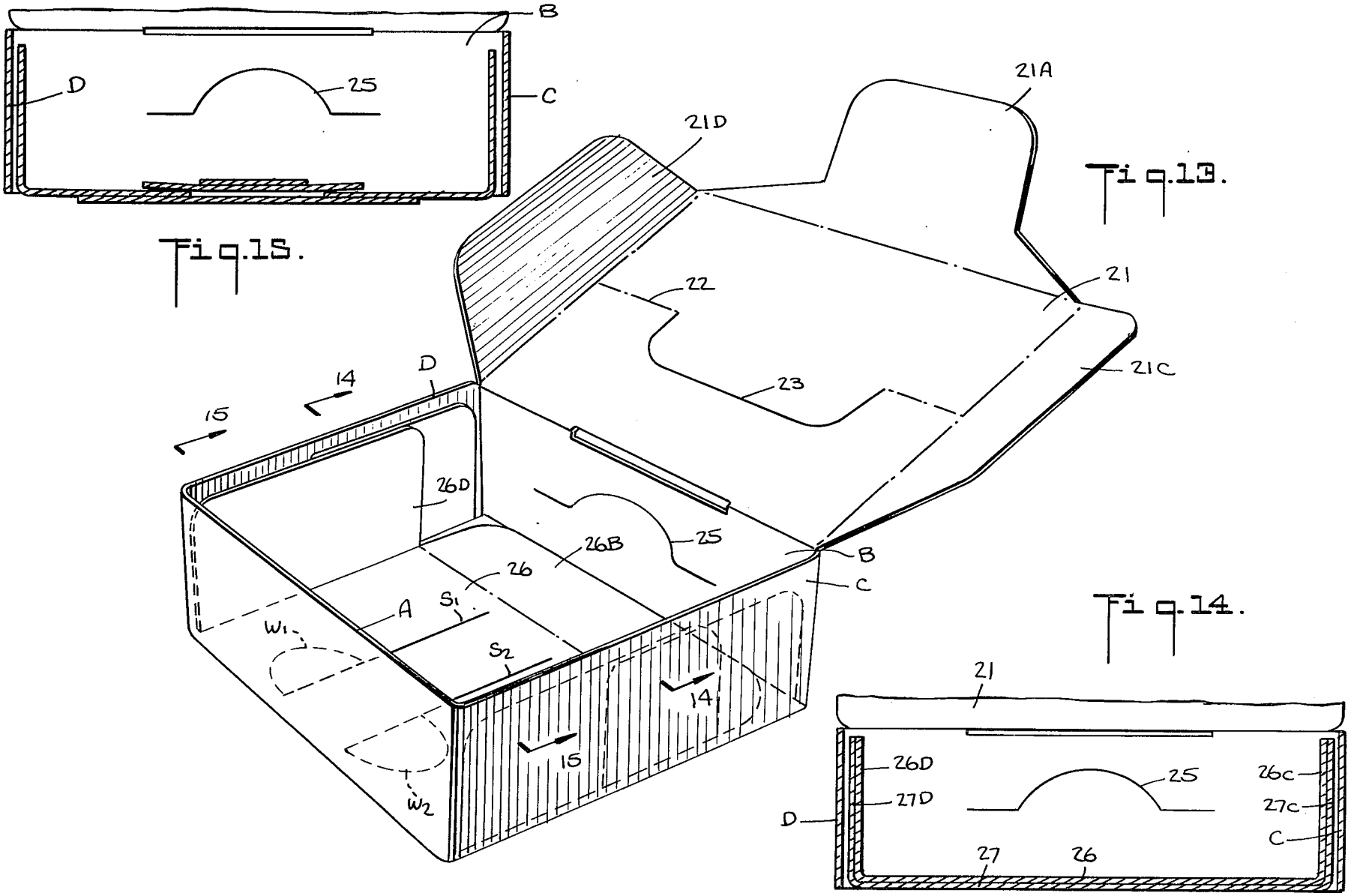
FIG. 13 illustrates the carton in its storage mode with its cover open.
FIG. 14 is a section taken in the plane indicated by line 14—14 in FIG. 13.
FIG. 15 is a section taken in the plane indicated by line 15—15 in FIG. 13.
Figure 16:
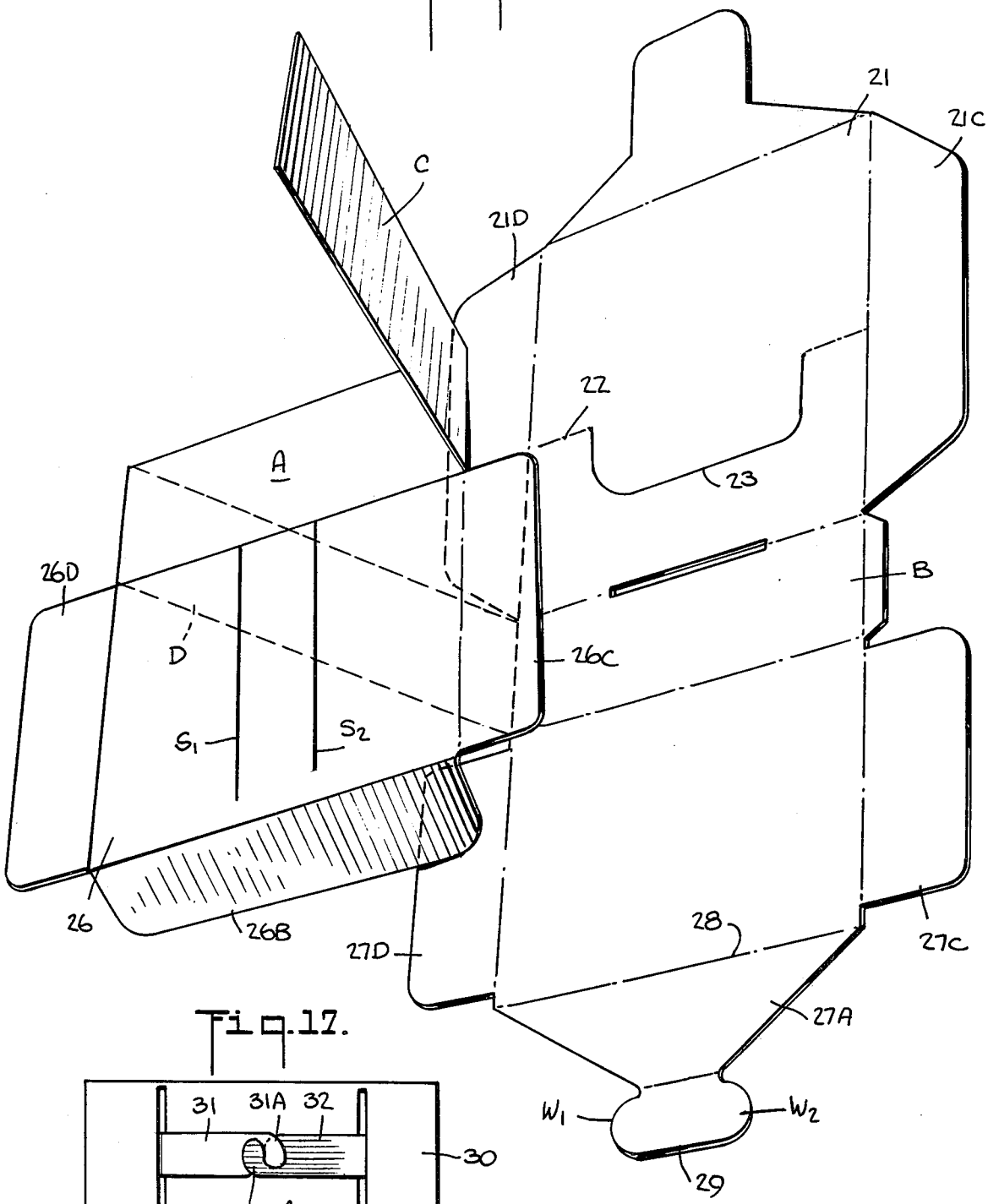
FIG. 16 is an expanded view of the single blank from which the carton is fabricated.

Referring now to FIGS. 1 to 4, there is shown a convertible carton in accordance with the invention, generally designated by numeral 10, the carton including an open rectangular shell having front and rear walls A and B and side walls C and D. The carton is completed by a drop-out base D0, which has an inactive state causing the carton to function in a storage mode, and an active state in which the carton functions in the jumble mode.

In the storage mode of the carton as shown in FIG. 1, when the carton is filled with goods tightly-packed in an orderly array, such as small boxes 11 of toothpaste which fully occupy the carton, the drop-out base DO is in its inactive or flat state and the carton then has a uniform depth. In this state, the carton functions conventionally to store and ship goods.

Also illustrated in FIGS. 1 and 2 is a collapsible, corrugated-board pedestal 12 which forms no part of the present invention, for such pedestals are known, per se. The structure and dimensions of the pedestal are such as to provide a raised support for carton 10 when it is caused to assume its jumble mode, as shown in FIG. 2, where it will be seen that drop-out base DO is activated to provide a bin having a trough-like structure.

The open bin thus formed now rests on one wall of the V-shaped trough, causing the rectangular shell defined by walls A, B, C and D to be inclined to afford ready access to the goods. The open bin need not be placed on a pedestal as shown, for it may be laid directly on the floor or on a table or shelf.

In practice, the convertible carton 10 in the storage mode may be filled with goods 11 and telescoped within a shipping carton which is large enough to also contain pedestal 12 in its collapsed condition. Thus the receiver of the goods is provided with a convertible carton for display of goods in the jumble mode and with the pedestal, nothing more being needed to set up the display.

In the convertible carton shown in FIG. 1, a flat cover 13 is provided having the same length and width as the carton so that it overlies the contents. Cover 13 includes a flap 13A which depends from the rear edge, the flap being folded down for insertion in a slot 14 in rear wall A of the carton. When, however, the carton is in its jumble mode, as shown in FIG. 2, cover 13 is raised so that the flap now extends downwardly from the cover. The cover is formed with score lines $L_1$ and $L_2$, so that its ends may be folded in to lie against the upper edge of rear wall B of the carton, thereby preventing the cover from leaning forward. Cover 13 is printed and otherwise decorated to serve as a sign board for the goods on display when the carton is in the jumble mode.

In order to hold flap 13A at a position appropriate to the storage mode when it is folded down so that cover 13 overlies the carton, and to the jumble mode when it is extended so that the cover is erected to act as a sign board, a humped metal pin 15 is provided, as shown in FIGS. 7 and 8. The ends of pin 15 are inserted in aligned sockets formed in cover 13 and in flap 13A, the hump overlying the junction of the cover and flap. By rotating the hump so that it lies in the plane of both cover and flap, as shown in FIG. 7, the flap is held in its extended state, whereas by rotating the hump 90°, it then acts as a right angle bracket to hold the flap at its folded-down condition.

Walls A, B, C and D, which form the rectangular shell of the carton, are each created by an outside section and inside section folded over the outside section, as shown in FIGS. 5 and 6, by inside and outside sections $A_I$ and $A_0$ of front wall A, and inside and outside sections $B_I$ and $B_0$ of rear wall B. Drop-out base DO is defined by an upper panel 16 which is hinged to outside section $A_0$ of front wall A, the upper panel overlapping a lower panel 17 which is hinged to outside section $B_0$ of rear wall B of the carton.

Upper side flaps 16 of drop-out base D0, as best seen in FIG. 9, is provided with a rear flap 16B and a pair of side flaps 16C and 16D, the sideflaps being inserted respectively between the outside and inside sections $C_0$ and $C_I$ and the outside and inside sections $D_0$ and $D_I$ of shell walls C and D. Upper panel 16 also includes a pair of parallel slots $S_1$ and $S_2$, whose purpose will be later explained.

Lower panel 17 of drop-out base $D_0$ is divided by a fold line 18 into a front section 17A and a back section 17B, as shown in FIG. 9. Back section 17B has a pair of side flaps 17C and 17D which are inserted between the respective outside and inside sections $C_0$ and $C_I$ and $D_0$ and $D_I$ of side walls C and D of the shell. Front section 17A is provided with a short flap 17A', which serves to accommodate couplers 19 and 20 that are inserted in slots $S_1$ and $S_2$ of upper panel 16 of drop-out base DO.

In order to facilitate the insertion of couplers 19 and 20, panel section 17A is provided with access holes $H_1$ and $H_2$ which, when the blank is formed into a convertible carton, are aligned with slots $S_1$ and $S_2$ (see FIG. 4). Thus couplers 19 and 20, which may be in the form of metal paper fasteners each having a pair of bendable metal tines joined to a flat head (see FIGS. 5 and 6), may be readily installed.

Each coupler is shiftable along its associated slot from an inactive position in which the lower panel 17, as shown in FIG. 5, is flat and the drop-out base is therefore in the storage mode, to an active position in which, as shown in FIG. 1, the base then assumes the configuration of a V-shaped trough. The walls of this trough are defined by the front and back sections 17A and 17B of lower panel 17. FIG. 6 shows the drop-out base DO at an intermediate point between the inactive and active positions.

When drop-out base DO assumes a trough-like form, the resultant bin has a larger volume than the carton in the storage mode, the bin then resting on front section 17A of lower panel 17. As a result, the shell formed by walls A, B, C, and D are inclined with respect to the vertical plane and the bin opening is tilted forward to provide ready access to the contents of the bin.

In practice, in order to jumble the contents of the carton and convert the carton from its storage to its jumble mode, it is only necessary to raise the carton above ground to thereby free drop-out base DO, so you the weight of the carton contents are imposed on the base. Sufficient downward pressure is then applied to the contents in the carton to force the base to drop out, as a consequence of which the neatly packed contents fall into the V-shaped trough and are disarrayed by this action. Hence, there is no need to deliberately disarrange the toothpaste boxes 11 or whatever goods are contained in the carton, for the act of conversion is accompanied by a jumbling action.

Second Embodiment

Referring now to FIGS. 10 to 16, there is shown another version of a convertible carton in accordance with the invention, the carton in this instance being a cardboard box of relatively small capacity as compared with the carton shown in the previous figures which is preferably made of heavy-duty corrugated board. This small carton can be used for counter displays, the goods shipped in the carton being jumbled when the base is dropped out to create an open bin.

The convertible carton includes a rectangular shell defined by front and rear walls A and B and side walls C and D, and a cover 21 hinged to rear wall B. Cover 21 is provided with a front flap 21A and side flaps 21C and 21D which when the cover is closed lie against the inner surfaces of walls A, C, and D, respectively.

Cover 21 is provided with a midline fold 2R and a U-shaped cut 23, so that, as shown in FIG. 12, when the cover is opened and folded along its midline 22, a mid-panel 24, which swings up from cut 23 when the fold is made, is presented as a sign board. To maintain the board erect, front flap 21A is inserted in a slit 25 in rear wall B. In this condition, the folded-over side flaps 21C and 21D form extension wings for the sign board presentation.

The drop-out base is constituted by an upper panel 26 hinged from front wall 26, upper panel 26 overlapping a lower panel 27 hinged from rear wall B. Upper panel 26 is provided with an end flap 26B and side Flaps 26C and 26D which, when the carton is assembled, lie against side walls B, C and D, respectively. Upper panel 26 also includes a pair of parallel slits $S_1$ and $S_2$.

Lower panel 27 is divided by a fold line 28 into a front section 27A and a back section 27B, the back section having side flaps 27C and 27D which fold in and lie against side walls C and D respectively.

Projecting forwardly from front section 27A is a coupler element 29 having side wings $W_1$ and $W_2$ which are inserted in slits $S_1$ and $S_2$ of the upper panel, whereby when converting from the storage mode to the jumble mode, the coupler shifts from the inactive to the active position and the panel 27 then assumes a V-shaped trough-like configuration, as shown in FIG. 12.

Third Embodiment

Figure 17:
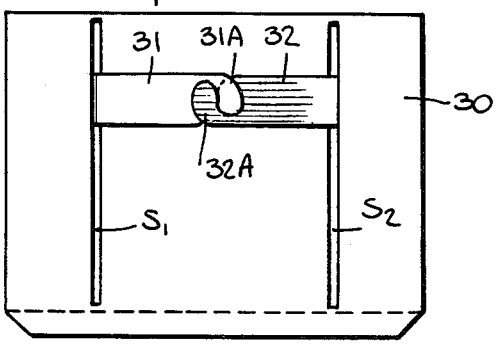
FIG. 17 is a bottom view of a third embodiment of a convertible carton in accordance with the invention.

The third embodiment of the invention is essentially the same as the first embodiment except that, as shown in FIG. 17, slots $S_1$ and $S_2$ are formed in outer panel 30 of the drop out base, and instead of metal fastener couplers, the inner panel is provided with a pair of arms 31 and 32 which have fingers 31A and 32A that interlock to define a loop, thereby affording the necessary coupling between the drop-out panels. This carton functions in the same manner as that in FIG. 1 to provide a jumble display of the goods contained therein.

While there have been shown and described preferred embodiments of a convertible carton in accordance with the invention, it will be appreciated that many changes and modifications may be made therein without, however, departing from the essential spirit thereof.

I claim:

1. A convertible carton which is capable in a storage mode of containing a multiplicity of like items in an orderly array and when converted to assume an open-bin form in a jumble mode to display these items in disarray, the carton comprising:

A. a rectangular shell having front, rear and side walls; and

B. a drop-out base secured to said shell, said base in the storage mode being flat to provide a carton of uniform depth and having a predetermined interior volume sufficient to accommodate said items in an orderly array, said base in the jumble mode having a V-shaped trough-like configuration serving to enlarge the interior volume of said carton, whereby the arrayed items then drop into the trough-like base and assume random positions therein to create said disarray.

2. A carton as set forth in claim 1, wherein said base is formed by overlapping upper and lower panels hinged respectively from the front and rear walls of the shell.

3. A carton as set forth in claim 2, wherein the lower panel is divided by a fold line into a front and back section, the front edge of the front section being secured by a coupling element to a slot in the upper panel whereby the coupling element is slidable in the slot from an inactive position in which the lower panel is flat to an active position in which the front section and the back section assume said V-shape.

4. A carton as set forth in claim 3, wherein said coupling element is a paper fastener.

5. A carton as set forth in claim 3, wherein said coupling element includes a wing insertable in said slot.

6. A carton as set forth in claim 1, wherein each wall is a double wall having an outside and an inside section.

7. A carton as set forth in claim 6, wherein said panels have side flaps which are interposed between the inside and outside sections of the side walls.

8. A carton as set forth in claim 6, further including a removable cover having a flap which is inserted in a slot between the outside and inside sections of the rear wall.

9. A carton as set forth in claim 8, wherein said cover flap is adjustable from a fold-in position, in which the cover closes the carton, to a fold-out position, in which the cover is erect to form a sign board.

10. A shipping assembly comprising a carton as set forth in claim 1, which is telescoped within a shipping carton within which is also stored a collapsed pedestal for supporting the carton in its jumble mode.

11. A carton as set forth in claim 1, further including a cover hinged to the rear wall of said shell.

* * * * *